United States Patent [19]

Seversen

[11] 3,971,464

[45] July 27, 1976

[54] CONTROL MEANS FOR A VENDING MACHINE

[76] Inventor: Gordon F. Seversen, 245 Park Lane, Palatine, Ill. 60067

[22] Filed: Oct. 31, 1974

[21] Appl. No.: 519,574

[52] U.S. Cl. ..... 194/10; 194/DIG. 15

[51] Int. Cl.[2] ..... G07F 11/00

[58] Field of Search ..... 194/1 C, 1 D, 1 L, 1 N, 194/1 M, 9, 10, DIG. 15, DIG. 28

[56] References Cited

UNITED STATES PATENTS

| | | | |
|---|---|---|---|
| 3,783,987 | 1/1974 | Hanert et al. | 194/10 |
| 3,848,718 | 11/1974 | Bookout | 194/10 X |

*Primary Examiner*—Robert B. Reeves
*Assistant Examiner*—Joseph J. Rolla
*Attorney, Agent, or Firm*—Jerome Goldberg

[57] ABSTRACT

A control system for a product vending machine of any number of product selections (n) comprising a credit-device including a thyristor switch which is turned "on" after the proper amount of coinage has been accepted by the machine, to prevent any additional coin acceptance until after the product has been selected and released. Pulsating direct current (DC) is generated through a diode bridge when the thyristor is "on". During the vend cycle, an electro-mechanical product release mechanism controls a vend switch, which switches from a normal to a vend-position, to cause the credit thyristor to switch "off" and also to prevent the vending machine from accepting coins until the end of the vend cycle, when such switch is switched back to the normal-position. The product release mechanism may utilize either a motor-cam arrangement or a solenoid.

29 Claims, 4 Drawing Figures

CONTROL MEANS FOR A VENDING MACHINE

BACKGROUND OF THE INVENTION

The invention relates generally to a vending machine for dispensing products, and more specifically relates to a control means for a coin operated vending machine having a plurality of product selections.

In many prior control systems for vending machines, a credit signal is generated after the proper coins have been accepted by the vending machine. Upon activating a product selection switch when the credit signal is present, a product release means such as a solenoid means or a motor means, caused the product to be released.

In the prior electromechanical vending control systems, as for example of the relay version, finite delay periods, such as the relay drop out time, were inherent in these systems. Thus, the possibility of beating or cheating the system nearly always existed. Many of the more recent vending machine controls comprised solid state circuitry which on the most part, eliminated the undesirable long delay periods. In a previous solid state system, a a credit-thyristor switch was used to switch from one state to another state, in response to the credit signal, (after the proper coins were accepted by the machine) to cause charging of a trigger capacitor. When a product selection was made, the voltage from the trigger capacitor was coupled via the product selection switch to the gate of an activator-thyristor switch, to fire "on" the thyristor, thereby providing a discharge path for a storage capacitor through the corresponding product release solenoid and the activator-thyristor. The product was released the solenoid was de-energized, and the thyristor switches were switched back to their normal positions, after the storage capacitor had discharged. Although the afore-described solid state system was operable, its complexity and cost precluded any extensive commercial use thereof. The subject invention on the ohter hand, improves thereover by greatly simplifying the solid state circuitry and the cooperative parts between such circuits and the electromechanical elements of the vending machine.

SUMMARY OF THE INVENTION

The control system for a coin operated vending machine of the invention herein comprises a credit means including a credit-thyristor means which is fired "0n" when the proper amount of coins have been accepted by the machine. The onstate for the credit-thyristor disables the coin return electromagnetic means (CREM) which prevents the machine from accepting any additional coins. Upon manually depressing or activating a product selection switch when the thyristor is "on ", an electromechanical product release means is energized via the credit thyristor, to start the vend cycle for releasing the desired product.

The operation of the product release means switches a vend switch to a vend-position from a normal or credit-position, to sever electrical power from the credit-thyristor and causing it to switch "off", and to connect electrical power to the energized product release means. After the product is released, the vend switch is switched back to the credit-position, disconnecting electrical power from the product release means and connecting electrical power to the credit-thyristor and CREM means. The vending machine is now ready to accept coins and provide another vend.

It is therefore a primary object of the subject invention to provide a simplified and effective control system for vending machines.

Another object is to provide a control system for controlling the operation of a motorized product release means.

Another object is to provide a control system for controlling the operation of a solenoid driven product release means.

Another object is to provide a solid state control, utilizing electromechanical switching arrays which are used in the completely electromechanical system.

Another object is to provide a credit-thyristor powered from a diode bridge after the thyristor is fired "on ". A related object is to short out a coin return electromagnetic means (CREM) upon switching the thyristor "on".

Another object is to utilize the credit-thyristor to provide electrical power for initially energizing a product release means.

Still another object is to automatically switch "off " the credit-thyristor after the product release means has been initially energized, and prevent the switching "on" of such thyristor until after a vend has been made.

Still another object is to provide an electrical path for maintaining a product release means activated, and severing such electrical path automatically after a predetermined time period for de-activating such release means.

BRIEF DESCRIPTION OF THE DRAWINGS

Referring to the drawings in which the same characters of reference are employed to indicate corresponding or similar parts throughout the several figures of the drawings.

DESCRIPTION OF THE PREFERRED EMBODIMENT

Figure 1:
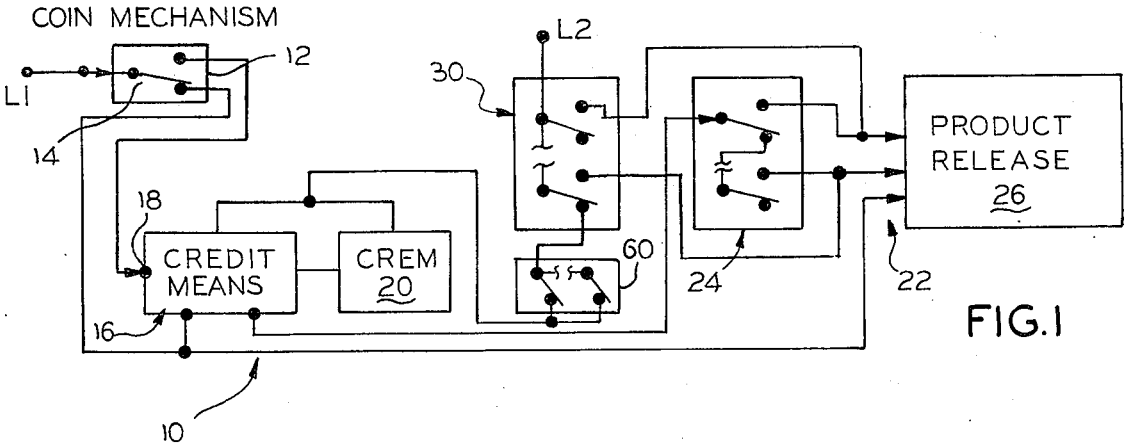
FIG. 1 is a block diagram of a control system for a product vending machine, embodying the principles of the invention.

Referring now to FIG. 1 of the drawings, the reference numeral 10 indicates generally a control system for a coin operated vending machine of a plurality of *n* number of product selections. After the proper coinage has been accepted by a coin mechanism 12, a credit switch 14 is switched momentarily from a normal-position (shown in the figures) to a credit-position for producing a "credit" signal.

The credit signal is applied to a credit means indicated generally by the reference numeral 16 at an input point 18, causing the credit means 16 to switch from a normally off-state to a credit-state. The selected product can only be released when the credit means 16 is in the credit-state.

A coin return electromagnetic means 20, also referred to herein as CREM means 20, has a coin accept-condition and a coin reject-condition. When the credit means 16 is in the credit-state, the CREM means 20 is in the coin reject-condition. Conversely, when the credit means 16 is in the off-state, the CREM means 20 is in the coin accept-condition except when the vending machine is in a product release or vend cycle. During a vend cycle, the CREM means 20 is in the coin reject-condition, and the credit means 16 is in the off-state. CREM means 20 is part of coin mechanism 12.

A product-select/release means indicated generally by the reference numeral 22 includes a bank of product-select switches 24, which is connected to a bank of electro-mechanical product release means 26. When the desired product is selected by activating one of the product-select switches after the credit signal has been generated by the credit switch 14, the product release or vend cycle will commence and the product will be released.

A bank of vend switch means 30 is provided to connect upon the commencing of the vend cycle, alternating current (AC) power from line L2 to the product release means 26*a* or 26*b*, and simultaneously cause the credit means 16 to switch from the credit-state back to the off-state. At the end of the vend cycle, the vend switch means 30 severs the AC electrical path between line L2 and the product release means 26.

Figure 2:
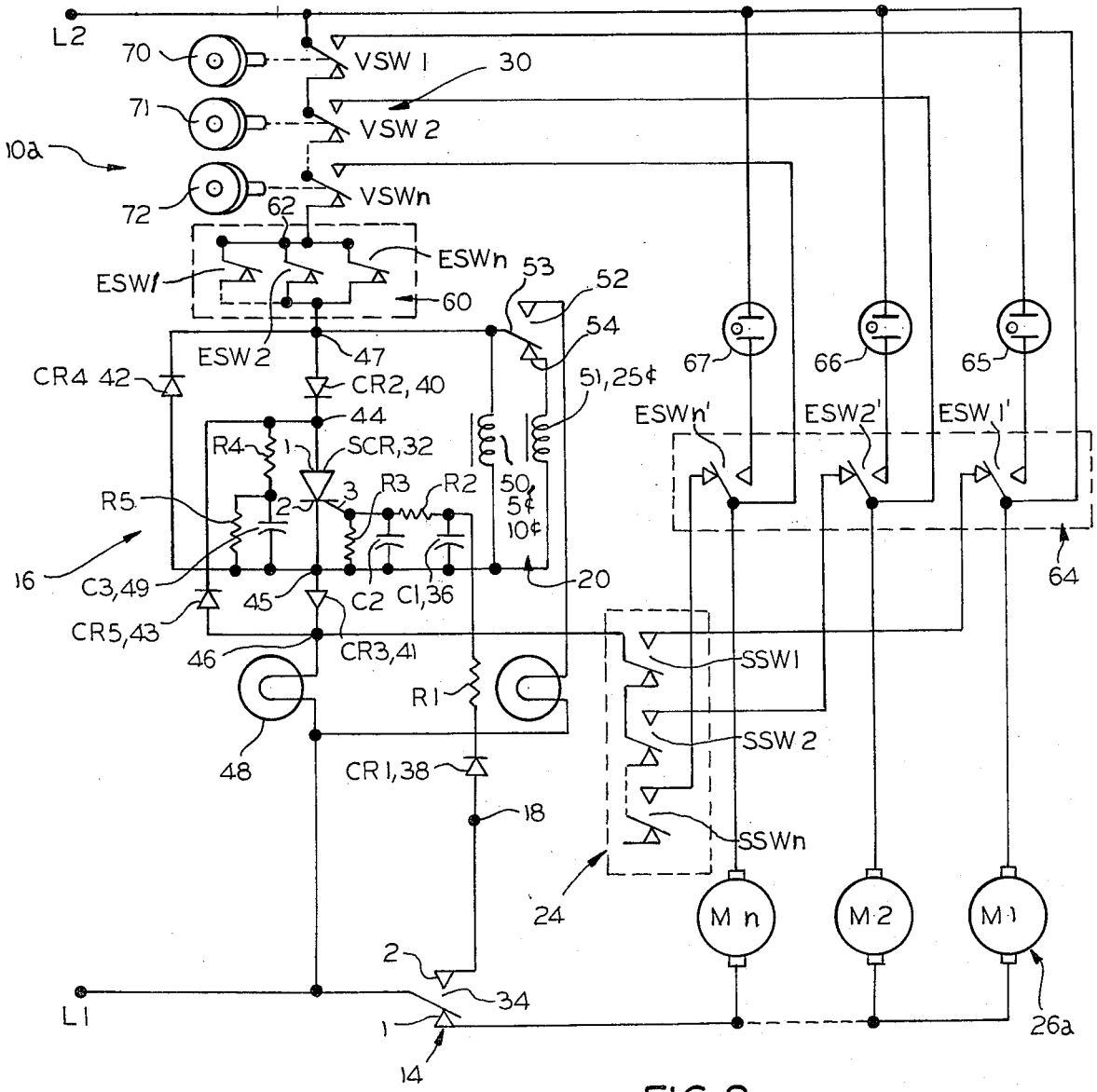
FIG. 2 is an electrical schematic of the control system using a motor drive means for releasing the selected product.
Figure 3:
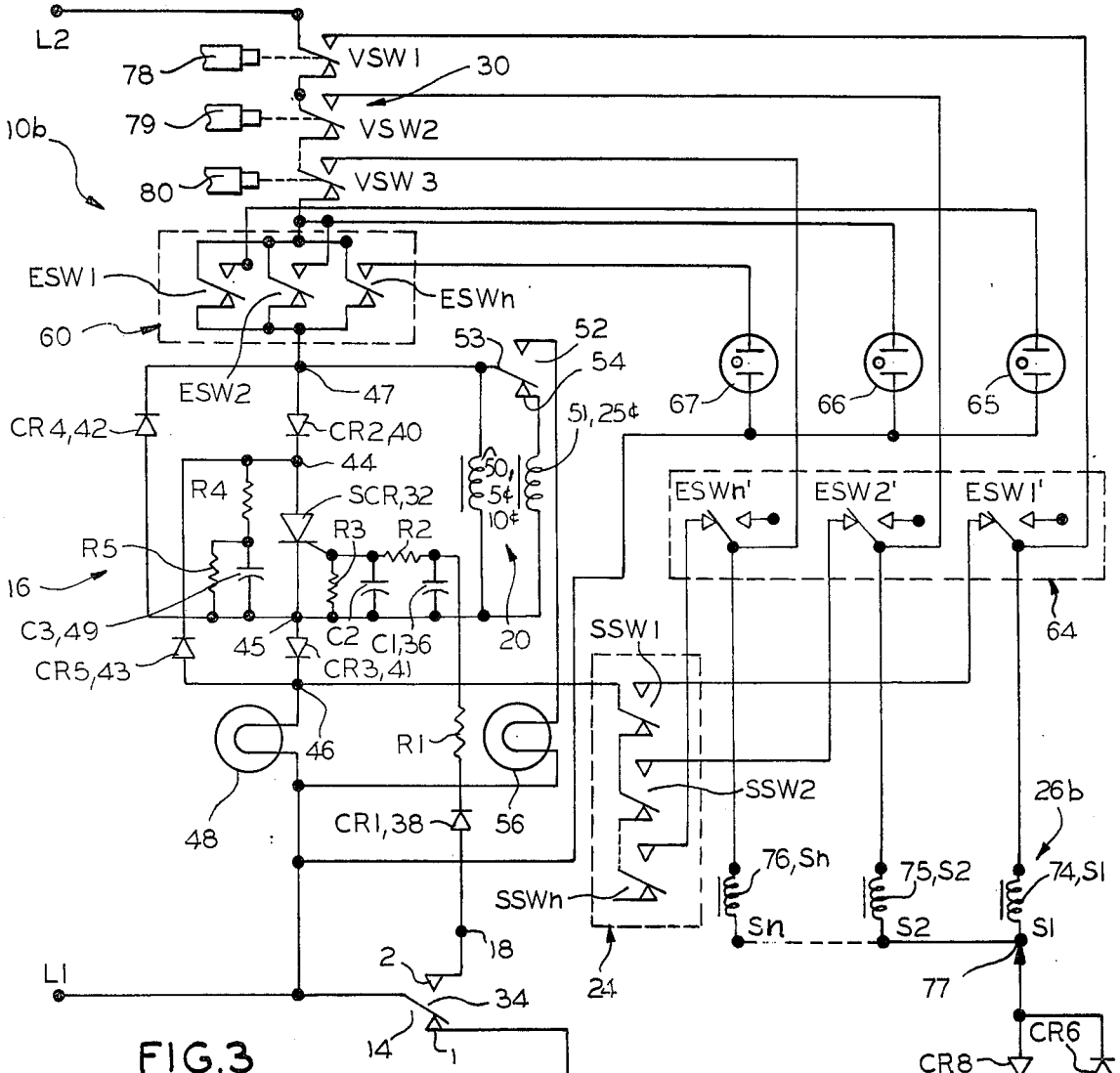
FIG. 3 is an electrical schematic of the control system using a solenoid drive means for releasing the selected product.

The control systems in FIGS. 2 and 3 are identified respectively by the reference indications 10*a* and 10*b*. The control system 10*a* and 10*b* are primarily the same except for the product-select release means identified respectively 26*a* and 26*b*. Product release means 26*a* utilizes motor drive means (M1, M2 and Mn), whereas product release means 26*b* utilizes solenoid drive means (S1, S2 and Sn) and a shut off timer means 31 for turning off the electrical power to the solenoid means.

Figure 4:
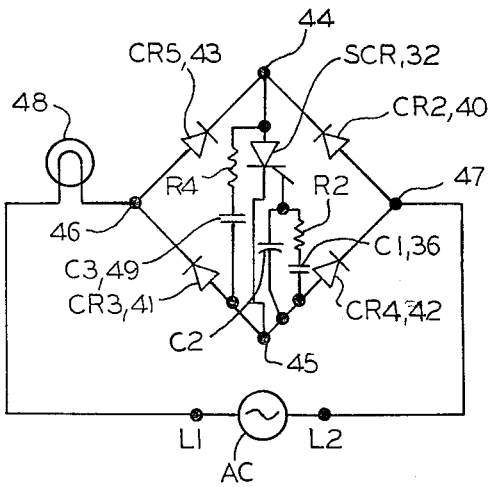
FIG. 4 is a schematic of the SCR and diode bridge portion of the credit means.

Referring now specifically to FIGS. 2 and 4, the control system 10*a* will be described. However, most of the description will be applicable to system 10*b*. The credit means 16 comprises a credit thyristor such as silicon controlled rectifier ("SCR") 32, which is fired "on" when the credit signal is generated and is switched "off" when the vend cycle commences. When the proper coinage has been accepted by the vending machine, the arm 34 of credit switch 14 from coin mechanism 12 switches from contact 1 (normal-position) to contact 2 (credit-position), for momentarily connecting thereto the AC line voltage from line L1. The positive portion of the AC cycle is connected from point 18 to capacitor C1,36 via diode CR1,38 and resistor R1. Capacitor C1,36 charges up to a positive voltage, which is coupled via resistor R2 to the gate 3 of SCR 32 and across resistor R3, causing SCR 32 to fire "on". Capacitor C2 and resistor R3 function as a filtor to prevent the SCR from firing due to transient pulses etc.

As may be seen particularly in FIG. 4, diodes CR2, 40, CR3,41, CR4,42, CR5,43 are connected into a bridge configuration. The cathodes of diodes CR2 and CR5 are connected at point 44, and the anodes of diodes CR3 and CR4 are connected at point 45. The anode of SCR 32 is tied to point 44 and the cathode of SCR 32 is tied to point 45. The cathode of diode CR3 and the anode of diode CR5 are connected to point 46, and the anode of diode CR2 and the cathode of diode CR4 are connected to point 47. A current limiting lamp 48 is connected between point 46 and AC line L1. Other current limiting devices may be suitable replacements for lamp 48.

After SCR 32 is fired "on" by the credit pulse from credit switch 14, positive current from AC line L2 flows from point 47, diode CR2,40, SCR 32, point 45, diode CR3,41, point 46, current limiting lamp 48, and into line L1 for return to the AC source. Positive current from AC line L1, flows from lamp 48, point 46, diode CR,5,43, point 44, SCR 32, point 45, diode CR4,42, point 47 and eventually to line L2 for return to the AC source.

Resistor R4 in series with the parallel connection of resistor R5 and capacitor C3,49 are connected between the anode 1 and cathode 2 of the SCR 32. During current conduction through SCR 32, capacitor C1 and capacitor C3 are charged. When the AC current sine wave from the AC source approaches the zero current level, (the pulsating DC through credit means 16 also approaches zero) capacitor C3 provides current flow through SCR 32 to prevent SCR 32 from turning off due to a zero or near zero AC current magnitude. Capacitor C1 also provides a firing bias voltage for maintaining the SCR "on". Therefore, the cooperation of capacitors C1 and C3 with resistors R2, R3 and R4, maintains a holding current through SCR 32 until the AC current magnitude passes from zero-current into either the positive or negative portion of the AC cycle. Resistor R5 provides a discharge path for capacitor C3 when SCR 32 is switched off.

The bank of product selection switches 24 comprises selection switches SSW1, SSW2 and SSW*n*. Each selection switch has an off-position as shown in the drawings, and a product select-position. When the credit means 16 is off and the CREM coils 50, 51 are energized, the manual switching of any of the product select switches SSW1, SSW2 and SSW*n* has no effect since the voltage applied across the product release means 26*a* is insufficient in magnitude to power any of the motor means M1, M2 or M*n*. When the CREM 20, which is part of coin mechanism 12, is de-energized and the SCR 32 is in the credit-condition, the manual depressing or switching of any of the selection switches SSW1, SSW2 or SSW*n* connects AC line L2 power to the corresponding motor means M1, M2 or M*n* via SCR 32, in the form of pulsating direct current.

The CREM means 20 includes an electromagnetic coil 50 for controlling acceptance of five and ten cent (nickel and dime) coins, and an electromagnetic coil 51 for controlling acceptance of 25 cent (quarter) coins. A tube switch 52 also part of coin mechanism 12, connects and disconnects the 25 cent coin coil 51 from the energizing path. When the movable arm 53 is in contact with terminal 54, coil 51 is in the energizing path and when the arm 53 is in contact with terminal 55, coil 51 is out of the energizing path and correct change lamp 56 is lighted.

When the credit SCR 32 is off, the CREM means 20 is energized except during a vend cycle, as the positive portion of the AC current wave flows from AC line L2, point 47 and coil 50 and coil 51 (if arm 53 of switch 52 is in contact with terminal 54), point 45, diode CR3, credit lamp 48 and AC line L1. The negative portion of the sine wave is inhibited from passing by diode CR3 which is in series with the coils 50, 51. Diode CR4 functions as a "free wheeling " diode and shorts out any reverse currents, such as the back electromotive force currents generated when CR3 stops conducting due to the reversing polarity of the line voltage.

When SCR 32 is switched "on" upon the proper coinage being accepted by the vending machine, the energizing current is diverted from flowing through CREM coils 50, 51, and passes instead through the credit SCR 32, causing the CREM coils 50, 51 to de-energize. This prevents any additional coinage from being accepted by the machine.

A first set of empty switches identified generally by the reference numeral 60 is connected between the credit means 16 and vend switches 30. When all the products in the vending machine have been released, the connection between the credit means 16 and the vend switches 30 is severed, which de-energizes the CREM coils 50, 51 and prevents the vending machine from accepting any coins. The first set of empty switches 60 include empty switches ESW1, ESW2 and ESW*n* connected in parallel. One stationary contact of the empty switches 60 are connected to the credit meand 16 at point 47 and the movable arms are connected to vend switches 30 at point 62. Each empty switch ESW1, ESW2, and ESW*n* has a product release-position (as shown) and an empty-position.

A second set of empty switches identified generally by reference numeral 64 is interposed between the selection switches 24 and the product release means 26*a*. The second set of empty switches 64 includes empty switches ESW1′, ESW2′ and ESW*n*′. Each empty switch includes a product release-position (as shown) and an empty-position. When empty switches ESW1′, ESW2′ and ESW*n*′ are in the product release-positions, the selection switches SSW1, SSW2 and SSW*n* are connected respectively to motor means M1, M2 and M*n*. When any or all of empty switches ESW1′, ESW2′ and ESW*n*′ are in the empty position, the corresponding connection between the selection switches 24 and motors M1, M2 and M3 is severed.

Lamps 65, 66 and 67 are tied respectively between AC line L2, and the empty-position of empty switches ESW1′, ESW2′ and ESW*n*′. When any of the set of empty switches 64 is in the empty-position, the corresponding lamp 65, 66 or 67 lights as current flows through the lamp from line L2 to line L1 via the corresponding motor coils of M1, M2 or M*n*. When all of a single product has been released, as for example the product associated with selection switch SSW1 and motor M1, empty switch ESW1 and empty switch ESW1′ both switch from their product release-positions to their empty-positions.

The bank of vend switches 30 includes a plurality of series connected vend switches VSW1, VSW2, and VSW*n*, each having a normal or credit-position and a vend-position. When all the vend switches 30 are in the credit-position, AC line L2 is connected to credit means 16 and to CREM means 20. When any one of the vend switches VSW1, VSW2 or VSW*n* has switched from the credit-position to the vend-position, the connection of L2 with credit means 16 is severed and a connection of line L2 is made with the motor M1, M2 or M*n* corresponding to the selected product. After the product has been released, that vend switch in the vend-position is switched back to the credit-position. Now AC line L2 is connected via the series connection of vend switches 30 to the credit means 16 and to CREM means 20.

Each motor means M1, M2 and M*n* includes a cam means identified respectively by reference numerals 70, 71 and 72 for switching respectively vend switches VSW1, VSW2 and VSW*n* at the beginning of the vend cycle, from the credit-position (shown) to the vend-position. At the end of the vend cycle, the operating cam 70, 71 or 72, switches the corresponding vend switch VSW1, 2 or *n* from the vend-position back to the credit-position. Since all of the vend switches are in the credit-position the CREM means 20 is energized, and the credit means 16 is ready to be turned "on". Now system 10*a* is ready to provide another vend.

Turning now to FIG. 3 the control means 10*b* having a solenoid driven product release means 26*b*, will be described. Similar to the motor driven product release means 26*a*, each solenoid S1, S2 or S*n* is energized after the corresponding selection switch SSW1, SSW2 or SSW*n* is depressed or otherwise activated when the credit means 16 is in the credit state.

The solenoid coils 74, 75 and 76 of solenoids S1, S2 and S*n* are each connected at one end to timer means 31 at point 77, and at the opposite end respectively to vend switches VSW1, VSW2 and VSW*n*. Solenoids S1, S2 and S*n* drive switch activator brackets identified respectively by reference numerals 78, 79 and 80, for switching respectively vend switches VSW1, VSW2 and VSW*n* from the credit-position (shown) to the vend-position at the beginning of vend cycle and from the vend-position back to the credit-position at the end of the vend cycle.

The shut-off timer means 31 is interposed between line L1 and the solenoids S1, S2 and S*n*. After the selected product has been released, the timer means 31 severs the connection of line L1 with the energized solenoid S1, S2 or S*n*. This de-energizes the solenoid, which causes the corresponding vend switch VSW1, VSW2 or VSW*n* to switch from the vend-position back to the credit-position.

As may be seen from FIG. 3, one end of the empty lamps 65, 66 and 67 is connected directly to line L1 and the opposite end of the lamps is tied to the "empty" contact of the bank of empty switches 60. When all of a specific product has been depleted, the corresponding empty switch ESW1, 2 or *n* switches to the empty position and the corresponding lamp derives line L2 voltage via the series vend switches 30 and lights.

The timer means 31 includes a silicon controlled rectifier SCR 82 which when turned on, provides an electrical pathway for the voltage from line L1 to the common side of the solenoid bank 26*b*. A programable unijunction transistor ("P.U.T.") 84 is triggered "on" after a predetermined time period to turn off the timer means 31 by preventing SCR 82 from being triggered on and thereby severing the electrical path between L1, and the solenoids. Other timing means could be used for this function.

Diodes CR6, CR7, CR8 and CR9 are connected into a bridge configuration. The cathode of diodes CR7 and CR8 are tied to point 85, and the anodes of diodes CR6 and CR9 are tied to point 86. Diode CR10 is connected between point 85 and resistor R7 and capacitors C4 and C5. Diode CR12 is connected between the anode 8 of P.U.T. 84 and the gate 3 of SCR 82. The junction of capacitor C4 and resistor R9 is connected to gate 7 of transistor 84. Resistor R7 and the anode of diode C12 are connected to anode 8 of P.U.T. 84. The cathode 5 of P.U.T. 84, resistors R9 and R6 and capacitor C5 are tied to point 86.

In operation, when the proper coinage has been inserted and accepted by the vending machine and a product selection switch from switch bank 24 is activated, the solenoid corresponding to the selected product is energized as current flows through the diode bridge and SCR 32 of credit means 16 and the diode bridge and SCR 82 of timer means 31. After the solenoid is energized, the corresponding solenoid controlled switch from switch bank 30 connects line L2 voltage to the solenoid, and simultaneously severs the AC current path through the credit means 16.

After the product selection has been made, capacitor C5 in timer means 31, is charged via diode CR10 to a positive voltage level. As the charge of capacitor C5 builds up, the voltage across resistor R6 increases to a voltage greater than the voltage drop across the gate to cathode of SCR 82, causing SCR 82 to be triggered on. Component values are selected so that trigger voltage for SCR 82 is present every half cycle, which prevents SCR 82 from being turned off for any appreciable time duration after the pulsating DC voltage approaches zero. When a current flows through the timer means 31 via SCR 82, the P.U.T. 84 is "off" since the voltage at the gate 7 is greater than the voltage at the anode 8. As capacitor C4 charges through resistor R9, the voltage across resistor R9 decreases until it is less than the voltage across diode CR12 and resistor R6. When this occurs, the P.U.T. 84 triggers "on", essentially shorting out the trigger input across diode CR12 and resistor R6, the effect of which is to turn off the timer means 31 since the gate voltage drops lower than required to trigger SCR 82.

Diodes CR6, CR7, CR8 and CR9 are bridge diodes which provide a direct current pulsating voltage to timer control SCR 82. Voltage versus timing regulation is achieved in the circuit since both inputs to the P.U.T. 84 are across capacitor C5.

The description of the preferred embodiments of this invention is intended merely as illustrative of the subject invention, the scope and limits of which are set forth in the following claims.

I claim:

1. A control system for a vending machine comprising:

means for producing a credit signal after a predetermined legal tender is accepted by the machine;

a credit means having an off-condition and a credit-condition, said credit means being switched to the credit-condition after said credit signal is generated, said credit means preventing acceptance of said legal tender when in the credit-condition;

product select switch means having an off-position and a select-position;

product release means having an activated state and a de-activated state, the switching of the product select switch from the off to the select-position when the credit means is in the credit-condition causing said product release to switch to said activated state from the de-activated state for releasing the product during a vend cycle; and a vend switch having a credit-position and a vend-position, said vend switch in the credit-position providing an electrical path for electrical power to the credit means when the credit means is in the credit-condition, said vend switch severing said electrical path to the credit means when switched to the vend-position, said vend switch in the vend-position providing an electrical path for electrical power to the product release means.

2. The control system of claim 1 including a CREM means having a coin accept-condition and a coin reject-condition, said vend switch enabling said CREM means to be in the coin accept-condition when the credit means is in the off-condition and the vend switch is in the credit-position.

3. The control system of claim 1, wherein said credit means provides electrical power for the product release means when in the credit-condition and after the product select switch is switched into the select-position.

4. The control system of claim 1, wherein said vend switch provides electrical power to said product release means after said credit means is switched from the credit-condition to the off-condition.

5. The control system of claim 1, wherein said product release means includes motor means and a cam means, said cam means causing said vend switch to switch from the credit-position to the vend-position.

6. The control system of claim 1, wherein said vend switch is switched to the vend-position when said product release means is switched to the activated state.

7. The control system of claim 6, wherein said product release means includes a motor means and means driven by said motor means for releasing the selected product during the vend cycle, said motor means causing said vend switch to switch from the credit to the vend-position when the motor means rotates during the vend cycle and said motor means causes the vend switch to switch from the vend-position to the credit-position when the vend cycle is completed.

8. The control system of claim 1, wherein said credit means includes a thyristor and said credit signal causing said thyristor to be switched from an off-state to an on-state.

9. The control system of claim 8, wherein said credit means includes means for providing a turn-on voltage for said thyristor after said credit signal is generated.

10. The control system of claim 9, wherein said means for providing said turn-on voltage includes capacitive means coupled to said thyristor for providing said turn-on voltage.

11. The control system of claim 10 including a coin return electromagnetic (CREM) means, having a first-state to permit acceptance of said legal teder, and a second-state to prevent acceptance of said legal tender, said CREM means being in said second-state when the credit means is in said credit condition, said CREM means being switched to said first-state when said product release means is switched back to the de-activated state.

12. The control system of claim 1 including timer means for switching the product release means from the activated state to the de-activated state after a predetermined period of time.

13. The control system of claim 12, wherein said timer means includes means for providing an electrical path for causing said product release means to switch from the de-activated state to the activated state after said product select switch is switched to the select-position.

14. The control system of claim 13 wherein said product release means includes solenoid means.

15. A control system for producing a credit signal after a predetermined legal tender is accepted by the machine;

a credit means having an off-condition and a credit-condition, said credit means being switched to the credit-condition after said credit signal is generated, said credit means preventing acceptance of said legal tender when in the credit-condition;

product select switch means having an off-position and a select-position;

a vend switch having a credit-position and a vend-position, said vend switch in the credit-position providing an electrical path for electrical power to the credit means when the credit means is in the credit-condition, said vend switch severing said electrical path to the credit means when switched to the vend-position; and a solenoid means having an activated state and a de-activated state and means driven by the solenoid means for releasing the selected product during the vend cycle, the energizing of said solenoid to said activated state causing said vend-switch to switch from the credit-position to the vend-position.

16. The control system of claim 15, including timer means for causing said solenoid means to de-energize after the corresponding product has been released.

17. A control system for a vending machine comprising:

means for producing a credit signal after a predetermined legal tender is accepted by the machine;

a credit thyristor having an on-state and an off-state, said credit signal causing said thyristor to switch from the off to the on-state;

an alternating current (AC) power source;

a diode bridge means associated with said thyristor and said alternating current power source, for providing direct current power through said thyristor when the thyristor is in the on-state;

product select switch having an off-position and a select-position;

product release means having an activated state and a de-activated state, the switching of the product select switch from the off to the select-position when the credit means is in the on-state causing said product release to switch to said activated-state from the de-activated state for releasing the product during a vend cycle; and means responsive to said product release means to cause said credit means to switch from the on-state to the off-state after the product release means is switched to the activated state, and further responsive to said product release means to enable the machine to accept said legal tender after said product release means is switched back to the de-activated state.

18. The control system of claim 17, wherein said credit-thyristor is associated with the product select switch for providing electrical power to said product release means, when the product select switch is in the select-position and said credit-thyristor is in the on-state.

19. The control system of claim 17, including current limiting means associated with the diode bridge, for controlling the amount of current flow.

20. A control system for a vending machine comprising:

means for producing a credit signal after a predetermined legal tender is accepted by the machine;

a credit means having an off-condition and a credit-condition, said credit means being switched to the credit-condition after said credit signal is generated, said credit means preventing acceptance of said legal tender when in the credit-condition;

product select switch means having an off-position and a select-position;

product release means having an activated state and a de-activated state, the switching of the product select switch from the off to the select-position when the credit means is in the credit-condition causing said product release to switch to said activated state from the de-activated state for releasing the product during a vend cycle, said product release means including solenoid means; and timer means including a thyristor means, for switching the product release means from the activated state to the de-activated state after a predetermined period of time, said thyristor including an on-condition for providing an electrical path for causing said product release means to switch from the de-activated state to the activated state after said product select switch is switched to the select-position.

21. The control system of claim 20, wherein said timer means includes a capacitive means, said thyristor switching to the off-condition for severing said electrical path after said capacitive means charges to a predetermined voltage level.

22. The control system of claim 20 wherein said control system includes a diode bridge to provide pulsating direct current (DC) current through said thyristor.

23. The control system of claim 20, wherein said timer means includes means for preventing said thyristor from triggering on after said predetermined time period.

24. The control system of claim 23, wherein the timer includes a capacitive means and a switch means having an on and off-condition, said switch means of the timer being transferred to the on-condition when the capacitive means reaches said predetermined level, said thyristor being switched off when said timer is in the on-condition.

25. A control system for a vending machine comprising:

means for producing a credit signal after a predetermined legal tender is accepted by the machine;

a credit means having an off-condition and a credit-condition, said credit means being switched to the credit-condition after said credit signal is generated, said credit means preventing acceptance of said legal tender when in the credit-condition;

product release means having an actuated state and a de-actuated state for releasing the product during the vend cycle;

a vend switch having a vend-position to prevent acceptance of said legal tender when the machine is in the vend cycle and an off-position to enable acceptance of said legal tender; and timer means having an operational-condition for causing said vend switch to switch into the vend-position, and an off-condition for switching the vend switch to the off-position.

26. The control system of claim 25 wherein said product release means includes motor means and said timer means includes cam means driven by the motor means.

27. A control system for a vending machine comprising:

means for producing a credit signal after a predetermined legal tender is accepted by the machine;

a credit means having an off-condition and a credit-condition, said credit means being switched to the credit-condition after said credit signal is generated, said credit means preventing acceptance of said legal tender when in the credit-condition;

product select switch means having an off-position and a select-position;

a vend switch having a credit-position and a vend-position, said vend switch in the credit-position providing an electrical path for electrical power to the credit means when the credit means is in the credit-condition, said vend switch severing said electrical path to the credit means when switched to the vend-position; and a solenoid means having an activated state and a de-activated state and means driven by the solenoid means for releasing the selected product during the vend cycle, said solenoid means causing said vend switch to switch from the credit-position to the vend-position during the vend cycle and the solenoid means causing the vend switch to switch from the vend-position to the credit-position when the vend cycle is completed, said vend switch in the vend-position providing an electrical path for electrical power to the solenoid means.

28. A control system for a vending machine comprising:

means for producing a credit signal after a predetermined legal tender is accepted by the machine;

a credit means including a thyristor and said credit signal causing said thyristor to switch from an off-state to an on-state, said credit means preventing acceptance of said legal tender when in the on-state;

product select switch having an off-position and a select-position;

alternating current (AC) power means;

capacitive means for charging when electrical current flows through the thyristor and discharging through said thyristor when the AC current from the AC power means approaches a substantially zero current magnitude;

product release means having an activated state and a de-activated state, the switching of the product select switch from the off to the select-position when the credit means is in the on-state causing said product release to switch to said activated state from the de-activated state for releasing the product during a vend cycle; and means responsive to said product release means to cause said credit means to switch from the on-state to the off-state after the product release means is switched to the activated state, and further responsive to said product release means to enable the machine to accept said legal tender after said product release means is switched back to the de-activated state.

29. The control system for a vending machine comprising:

means for producing a credit signal after a predetermined legal tender is accepted by the machine;

a credit means having an off-condition and a credit-condition, said credit means being switched to the credit-condition after said credit signal is generated, said credit means preventing acceptance of said legal tender when in the credit-condition;

product release means having an actuated-state and a de-actuated state for releasing the product during a vend cycle;

a vend switch having a vend-position to prevent acceptance of said legal tender when the machine is in the vend cycle and an off-position to enable acceptance of said legal tender; and timer means having an on-condition to enable said product release means to transfer into said actuated-state and said vend switch to switch into said vend-position, and an off-condition to cause said product means to switch back to the de-actuated state and said vend switch to transfer back to the off-position, said timer switching from the on to the off-condition after a preset time interval.

* * * * *